US005284166A

United States Patent [19]

Cartwright et al.

[11] Patent Number: 5,284,166

[45] Date of Patent: Feb. 8, 1994

[54] METHOD OF PRODUCING BROWN CIGARETTE WRAPPER PAPER

[75] Inventors: William F. Cartwright, Roswell; Sean M. Kelly, Alpharetta; David P. Pozzetta, Dunwoody, all of Ga.

[73] Assignee: Kimberly-Clark Corporation, Neenah, Wis.

[21] Appl. No.: 957,968

[22] Filed: Oct. 7, 1992

[51] Int. Cl.[5] ..... A24D 1/02

[52] U.S. Cl. ..... 131/365; 131/358; 162/139

[58] Field of Search ..... 131/365, 358; 162/139

[56] References Cited

U.S. PATENT DOCUMENTS

| | | | |
|---|---|---|---|
| 48,936 | 7/1865 | Hazman et al. | 131/365 |
| 2,809,904 | 10/1957 | Koree | 131/2 |
| 3,070,486 | 12/1962 | Novak | 162/139 |
| 3,070,487 | 12/1962 | Novak et al. | 162/139 |
| 3,112,754 | 12/1963 | Diaz | 131/2 |
| 3,447,539 | 6/1969 | Briskin et al. | 131/2 |
| 3,608,560 | 9/1971 | Briskin et al. | 131/2 |
| 3,831,609 | 8/1974 | Briskin et al. | 131/2 |
| 4,109,664 | 8/1978 | Hedge | 131/2 |
| 4,119,104 | 10/1978 | Roth | 131/2 |
| 4,129,134 | 12/1978 | Hind et al. | 131/2 |
| 4,146,041 | 3/1979 | Laszlo | 131/15 R |
| 4,195,645 | 4/1980 | Bradley, Jr. et al. | 131/2 |
| 4,238,283 | 12/1980 | Greene | 131/365 X |
| 4,534,371 | 8/1985 | White | 131/358 X |
| 5,094,253 | 3/1992 | St. Charles et al. | 131/365 |
| 5,101,840 | 4/1992 | Riehl, Jr. | 131/365 |

FOREIGN PATENT DOCUMENTS

| | | |
|---|---|---|
| 702917 | 2/1965 | Canada . |
| 702920 | 2/1965 | Canada . |
| 1483495 | 8/1977 | United Kingdom . |

OTHER PUBLICATIONS

"The Merck Index ", 8th ed., 1968, p. 536.

*Primary Examiner*—William H. Grieb
*Attorney, Agent, or Firm*—William D. Herrick

[57] ABSTRACT

There is disclosed a method of coloring cigarette paper. Cigarette paper is made by forming a furnish, adding at least one colorant to the furnish, forming a sheet of paper from the thus treated furnish, and adding at least one colorant to the paper to produce a variety of tans/-browns and red-brown cigarette wrapper.

24 Claims, No Drawings

METHOD OF PRODUCING BROWN CIGARETTE WRAPPER PAPER

FIELD OF THE INVENTION

The invention relates to a method for coloring paper for use as a wrapper for smoking products. More specifically, this invention relates to a method for producing a brown cigarette wrapper using both water-soluble natural colorants and water-insoluble natural colorants.

BACKGROUND OF THE INVENTION

In order to expand market opportunities, manufacturers of tobacco related products have increasingly begun to develop attractive specialty items to attract customers. Among these specialty items are cigarettes having brown wrappers. Brown wrappers are considered to impart a natural, earthy image and provide a cigarette wrapper having the appearance of tobacco. In order to obtain the desired brown color, it has been common to utilize FDA approved dyes and other artificial colorants. However, since some artificial colorants and dyes have been alleged to have detrimental health effects, some cigarette manufacturers have opted for natural colorants to avoid potential toxicological problems and to further promote the natural image.

It is well-known in the art to use natural colorants to color cigarette paper. Most of the prior art uses disclose the addition of natural colorants, such as caramel, chocolate and licorice, to the paper by impregnating, spraying, soaking or otherwise coating the paper with the colorant. One such attempt is taught by U.S. Pat. No. 4,146,041 which teaches a brown cigarette wrapper produced by staining conventional paper with humic acids or salts and then washing the paper with water to reduce the concentration of residual alkaline metal salts. However, such methods often have several disadvantages. For example, to produce a sufficiently dark wrapper, it is, depending upon the colorant, often necessary to use large amounts of the colorant. Adding too much colorant may have detrimental effects, such as reducing the porosity of the paper and thereby reducing the burn rate of the paper, producing unpleasant odors and increased smoke, and especially in the case of caramel, making the wrapper sticky or otherwise unappealing.

It is also known in the art to add colorants to the liquids slurry or furnish from which the paper is produced. One such method is to treat the furnish with iron (ferric) oxide. However, to obtain sufficiently dark results with this method, it is often necessary to use large amounts (in excess of 2% by weight of paper) of ferric oxide. Paper treated with such large amounts of ferric oxide is undesirable since the paper produces an undesirable rust colored ash when burned. This range of acceptable percentages is dependent upon several factors. Certain tipping papers, used for the cigarette tip which is not burned, may have between 6 and 8% of an iron oxide colorant. The upper limit of iron oxide may be as high as 1.5–2% in paper that will be burned, although at levels as low as 1% by weight the potential for red ash exists. The formation of a red ash may be ameliorated by the addition of caramel, licorice and other natural colorants. Also, the tobacco blend itself may reduce the formation of red ash. Additionally, ferric oxide gives the paper a flat, undesirable color when it is the only colorant used.

Therefore a need exists for a method by which cigarette paper can be treated with natural colorants to provide it with a sufficiently dark appearance without detracting from its function or appeal.

SUMMARY OF THE INVENTION

The present invention solves the above described need by providing a method of producing a brown cigarette wrapper by adding natural colorants to both the furnish and the paper without detrimentally affecting the performance or aesthetic qualities of the wrapper.

Generally described, the method of this invention comprises the steps of forming a conventional slurry or furnish from which the paper will be produced; adding a first colorant to the furnish; forming the paper from the thus treated furnish; and adding a second colorant to the paper.

The preferred method of this invention comprises the steps of forming a conventional furnish; adding an organic water-insoluble, natural colorant to the furnish; forming paper from the thus treated furnish; and adding a water-soluble, natural organic colorant to the paper. Water insoluble additives may also be used but require a dispersion/suspension aid.

In another aspect of the invention, non-organic, water-insoluble natural colorants, such as ferric oxide, may be added to the furnish. Certain water-soluble natural colorants may also be added to the furnish if they are reasonably substantive to cellulosic fibers (e.g., humic acid sodium salt). Additionally, partially water-soluble additives, such as cocoa powder, may be added to the furnish as means of introducing color variations in the base paper sheet.

Accordingly, an object of the invention is to provide a method for producing a brown cigarette wrapper.

A further object of the invention is to produce a brown cigarette wrapper by adding colorants to both the furnish and the finished paper.

Yet another object of the invention is to add water insoluble natural colorants to the furnish and to add water soluble natural colorants to the paper.

A still further object of the invention is to produce a brown cigarette wrapper having improved performance and aesthetic qualities.

DETAILED DESCRIPTION OF THE PREFERRED EMBODIMENT

The preferred embodiment of the present invention was developed for coloring conventional cigarette paper. The wet laying process by which cigarette paper is manufactured is well-known in the art as is evidenced by U.S. Pat. Nos. 4,739,775 and 4,450,847, hereby incorporated by reference, and need not be detailed here.

In the preferred embodiment of the invention, water-insoluble colorants and water-soluble natural colorants having water-insoluble components are added to the furnish prior to its exit from the headbox and the water-insoluble constituents are retained by the fibers. Water-soluble colorants are generally impregnated or coated onto the paper product that exits from the final rollers. When the manufacturing process is completed, the paper preferably meets the following specifications:

Porosity: between 5 and 55 cm/min (CORESTA)

Color: tan/brown/red-brown as represented by color swatch numbers 132–33, 139–40, 146–47, 153–54, 160–61, 167–68, 174–75, 180–81, 462–75, such numbers being referenced to the Pantone ® color specifier (1973 Pantone, Inc. 55 Knickerbocker Rd., Moonachie, N.J. 07074). Other color variations are, of course, possible.

The water-insoluble natural colorants useful in this invention are those colorants which, when added to the furnish, impart a deep brown color and may be used in low concentrations that do not impart undesirable qualities to the paper. When insoluble colorants are added to the furnish, the ultimate concentration in the sheet is determined by the retention level of the fine particles. Similarly, when the coating solution or impregnate is applied to the paper, the weight of the finished paper depends on the amount of the aqueous impregnate retained. Therefore, the concentrations listed below refer to concentrations by weight of additives in the furnish or in the impregnating solution. Specific examples of solution concentrations include iron oxides in concentrations between 0.3 and 5% and preferably between 0.5 and 2.0% and carbon in concentrations between 1.0 and 5.0%. It must be understood that the exact concentrations in the furnish is adjusted according to actual percent retention of the inorganic additive and thus the represented percentages are intended to be exemplary.

The water-soluble natural colorants useful in this invention are those colorants which, when added to the paper, adhere well to the paper, impart a deep brown color to the paper, and may be applied in concentrations which do not unacceptably reduce the final porosity of the paper, appreciably alter the finish or texture of the paper or otherwise affect the performance and aesthetic qualities of the paper. In the finished paper, as is known in the art, burn chemicals consisting of various salts (e.g., alkali metal citrates) can be included to obtain specified combustion properties. In addition, some adjustment of combustion properties can be obtained by manipulation of the level of the conventional calcium carbonate filler used in cigarette paper. Specific saturating solution examples include tobacco extracts in concentrations between 15 and 35%, caramel in concentrations between 10 and 50% and having a solids content between 50 and 90%, carmine in concentrations between 1 and 10%, and licorice in concentrations between 5 and 15%. Of course it will be understood that the concentration of additives in the saturating solution is adjusted, depending on the level of saturants absorbed by or coated on the paper, to achieve actual levels by weight in the finished paper which do not unacceptably alter the paper aesthetics or burn characteristics.

Carbonated cocoa may also be added to either the furnish or the paper, as it is generally water-soluble, but contains some water-insoluble components. Carbonated cocoa is preferably added to the furnish in concentrations of between 5 and 15% and may additionally or independently be added to the paper in concentrations of between 5 and 15%. It is also preferable to add a suspension/retention aid in dispersing the colorants added to the paper to insure more uniform coloring, and to help retain the colorant. An example of such a suspension/retention aid includes carboxymethyl cellulose at a concentration of between 0.25 and 1.5%. However, guar gum, methyl cellulose and other natural or synthetic gums may also be used as suspension/retention aids.

As will be apparent to one skilled in the art, many combinations of colorants may be used.

This invention is further illustrated by the following examples which illustrate certain embodiments designed to teach those of ordinary skill in the art how to practice this invention and to represent a best mode contemplated for carrying out this invention.

EXAMPLES

Example 1

A tipping paper was coated with as is Caramel Grade 050 (72.5% solids, supplied by D. D. Williamson). The paper contained approximately 7% yellow iron oxide and was very low in permeability (1 cm/min [CORESTA]). The color resulting was judged to be an appealing rich brown with reddish highlights.

However, the paper would not sustain combustion and produced a distinctly red ash.

Example 2—Unbleached Versus Bleached Pulp

Conventionally, cigarette paper is prepared from bleached flax fiber and chalk filler. The objective is to produce a very white, opaque sheet. However, production of a brown cigarette paper from this sheet is made more difficult because the whiteness must be fully masked. Using an unbleached softwood pulp should, therefore, prove beneficial in achieving brown cigarette papers. Use of minimal calcium carbonate filler, commensurate with combustion requirements is also beneficial in this regard. This is demonstrated by the series of handsheets shown below with their Hunter Colorimeter values. A nominal value of chalk was added to make these sheets since it assists burn.

| | Unbleached Domtar Q30 Softwood versus Bleached Flax Fiber | | | | | |
|---|---|---|---|---|---|---|
| Hunter Colorimeter | Pantone 160μ | Domtar Q30 | Coating Solution #1 | | Coating Solution #2 | |
| Values | Reference | Base Sheet | Domtar Q30 | Flax | Domtar Q30 | Flax |
| L | — | 77.8 | 37.1 | 36.2 | 36.4 | 42.4 |
| a | — | 2.8 | 5.9 | 6.8 | 6.6 | 7.2 |
| b | — | 17.5 | 12.4 | 12.6 | 12.8 | 15.8 |
| L* | 46.7 | 82.1 | 43.8 | 42.9 | 43.2 | 49.5 |
| a* | 15.9 | 2.9 | 7.5 | 8.8 | 8.4 | 8.9 |
| b* | 26.2 | 20.5 | 20.1 | 20.8 | 21.2 | 25.3 |
| Visual Assessment | brown-red | Light tan | deep brown | tan/brown | brown | tan |

Note:
The Hunter L* a* b* CIE Scale values are more representative of how the human actually perceives colors.

In both cases the bleached flax base sheet produced a less desirable brown than did the unbleached softwood base sheet. The levels of additives for this evaluation were also high. For example, a coating of approximately 40% of 050 Caramel on flax base paper produced a deep brown (L=31.2, a=11.4, b=10.9) but the paper had poor burn characteristics. The paper was also sticky which would result, in bobbin form, in "blocking". This would cause serious manufacturing problems due to breakage.

Consequently, use of unbleached softwood was chosen for further work because it could more easily be adjusted to brown or brown/red coloration with insoluble additives to the furnish such as carbon, iron oxides, carbonated cocoa and the like.

Example 3

A sheet was prepared from Domtar Q30 unbleached softwood pulp such that it contained 22% chalk (to assist burn) and approximately 2.6% iron oxides based on retention studies. The iron oxides were a 2:2:1 blend of red, yellow and black iron oxide, respectively, and were obtained from Pfizer Pigments. The base sheet was coated with a solution 1% in sodium carboxymethylcellulose (Aqualon 7M®), 10% carbonated cocoa, and 15% 050 Caramel by weight. Dispersion of the cocoa was further assisted by heating the slurry to 60° C.

The resulting sheet was judged to have a visually pleasing brown color. However, the ash produced on combustion was noticeably red.

Example 4

The method of Example 3 was followed except that the level of iron oxide was reduced by half to approximately 1.3%. The color was still judged visually to be a pleasing brown and had Hunter Colorimeter values of:

| | |
|---|---|
| L = 33.5 | L* = 40.0 |
| a = 7.9 | a* = 10.3 |
| b = 11.1 | b* = 18.6 |

Upon combustion the resulting ash possessed a barely noticeable reddish tint. Reducing the iron oxide content to approximately 1% completely eliminated this characteristic while still producing satisfactory brown colors.

Example 5

Sieved (140 mesh screen) carbonated cocoa was added to Domtar Q30 pulp such that the sheet contained 10–12% after formation. This was coated with a solution containing 1% NaCMC 7M and 50% 525 Caramel (82.5% solids). A rich brown sheet with slight red overtones was obtained with acceptable combustion and ash properties. The Hunter Colorimeter values were:

| | |
|---|---|
| L = 33.2 | L* = 39.7 |
| a = 9.7 | a* = 12.6 |
| b = 12.5 | b* = 21.8 |

The use of a viscosity agent such as NaCMC, or other synthetic or natural gums, has certain advantages. In the case of water-soluble coatings, it produces color of greater depth by prevention of penetration. The coating is thus held more on the paper surface than it would be in an aqueous solution without a viscosity agent. When water-insoluble additives are also included in the coating, the viscosity agent also serves as a dispersion/suspension aid.

Example 6

To further emphasize a red character, the sheet of Example 5 was prepared but also included 0.5% of red iron oxide. This was coated with a saturating solution of 10% 050 Caramel (72.5% solids) containing carmine (Warner Jenkinson) added as 10% of the weight of the caramel solids.

A brown/red color was produced which had acceptable burn and did not have a noticeably red ash.

As will be apparent, a range of colors may be produced by this invention from light tans to browns to brown/red.

The foregoing description relates to a certain embodiment of the present invention, and modifications or alterations may be made without departing from the spirit and scope of the invention as defined in the following claims.

We claim:

1. A method of making a colored paper for use as wrappers for smoking products which comprises the steps of:
   forming a furnish;
   adding at least one colorant to the furnish;
   forming the paper from the thus treated furnish; and
   adding at least one colorant to the paper.

2. The method of claim 1, wherein said colorants are natural colorants.

3. The method of claim 1, wherein said colorants added to the furnish are water-insoluble.

4. The method of claim 1, wherein said colorants added to the paper are water-soluble.

5. The method of claim 1, wherein said colorants are organics.

6. A method of making a colored paper for use as wrappers for smoking products which comprises the sequential steps of:
   forming a furnish;
   adding at least one water-insoluble natural colorant to the furnish;
   forming a paper from the thus treated furnish; and
   adding at least one water-soluble natural colorant to the paper.

7. A method of making a colored paper for use as wrappers for smoking products which comprises the sequential steps of:
   forming a furnish;
   adding iron oxide in a concentration of between 0.3 and 5% by weight to the furnish;
   forming a paper from the treated furnish; and
   adding at least one water-soluble natural colorant to the paper.

8. A method of making colored paper for use as wrappers for smoking products which comprises the sequential steps of:
   forming a furnish;
   adding carbon in a concentration of between 1 and 5% by weight to the furnish;
   forming a paper from the treated furnish; and
   adding at least one water-soluble natural colorant to the paper.

9. A method of making colored paper for use as wrappers for smoking products which comprises the sequential steps of:
   forming a furnish;
   adding at least one water-insoluble natural colorant to the furnish;
   forming a paper from the treated furnish; and
   adding an aqueous solution having tobacco extract in a concentration of between 15 and 35% by weight to the paper.

10. A method of making colored paper for use as wrappers for smoking products which comprises the sequential steps of:
forming a furnish
adding at least one water-insoluble natural colorant to the furnish;
forming a paper from the treated furnish; and
adding an aqueous solution having caramel in a concentration of between 5 and 50% by weight to the paper.

11. A method of making colored paper for use as wrappers for smoking products which comprises the sequential steps of:
forming a furnish
adding at least one water-insoluble natural colorant to the furnish;
forming a paper from the treated furnish; and
adding an aqueous solution having carmine in a concentration of between 0.1 and 10% by weight to the paper.

12. A method of making colored paper for use as wrappers for smoking products which comprises the sequential steps of:
forming a furnish
adding at least one water-insoluble natural colorant to the furnish;
forming a paper from the treated furnish; and
adding an aqueous solution having licorice in a concentration of between 5 and 15% by weight to the paper.

13. A method of making colored paper for use as wrappers for smoking products which comprises the sequential steps of:
forming a furnish
adding carbonated cocoa in a concentration of between 5 and 15% by weight to the furnish;
forming a paper from the treated furnish; and
adding at least one water-soluble natural colorant to the paper.

14. A method of making colored paper for use as wrappers for smoking products which comprises the sequential steps of:
forming a furnish
adding at least one water-insoluble natural colorant to the furnish;
forming a paper from the treated furnish; and
adding an aqueous solution having carbonated cocoa in a concentration of between 5 and 15% by weight to the paper.

15. A colored paper for use as wrappers for smoking products made in accordance with the method of claim 1.

16. A colored paper for use as wrappers for smoking products made in accordance with the method of claim 6.

17. A colored paper for use as wrappers for smoking products made in accordance with the method of claim 7.

18. A colored paper for use as wrappers for smoking products made in accordance with the method of claim 8.

19. A colored paper for use as wrappers for smoking products made in accordance with the method of claim 9.

20. A colored paper for use as wrappers for smoking products made in accordance with the method of claim 10.

21. A colored paper for use as wrappers for smoking products made in accordance with the method of claim 11.

22. A colored paper for use as wrappers for smoking products made in accordance with the method of claim 12.

23. A colored paper for use as wrappers for smoking products made in accordance with the method of claim 13.

24. A colored paper for use as wrappers for smoking products made in accordance with the method of claim 14.

* * * * *